US010577785B2

(12) United States Patent
Schuster

(10) Patent No.: US 10,577,785 B2
(45) Date of Patent: Mar. 3, 2020

(54) EXTERNAL HAIR STRAINER

(71) Applicant: Danco, Inc., Irving, TX (US)

(72) Inventor: Michael J. Schuster, Shorewood, IL (US)

(73) Assignee: Danco, Inc., Irving, TX (US)

( * ) Notice: Subject to any disclaimer, the term of this patent is extended or adjusted under 35 U.S.C. 154(b) by 0 days.

(21) Appl. No.: 15/973,263

(22) Filed: May 7, 2018

(65) Prior Publication Data

US 2018/0320348 A1 Nov. 8, 2018

Related U.S. Application Data

(60) Provisional application No. 62/502,971, filed on May 8, 2017.

(51) Int. Cl.
*E03C 1/262* (2006.01)

(52) U.S. Cl.
CPC ..... *E03C 1/262* (2013.01)

(58) Field of Classification Search
CPC ..... E03C 1/262
USPC ..... 4/292; D23/260–261
See application file for complete search history.

(56) References Cited

U.S. PATENT DOCUMENTS

| | | | | |
|---|---|---|---|---|
| 7,500,282 | B1 * | 3/2009 | Park | A47K 7/02 15/160 |
| 2009/0049594 | A1 * | 2/2009 | Landsberger | E03C 1/264 4/292 |
| 2010/0213140 | A1 * | 8/2010 | Won | E03C 1/264 210/767 |

* cited by examiner

*Primary Examiner* — Christine J Skubinna
(74) *Attorney, Agent, or Firm* — Thomas Horstemeyer, LLP

(57) ABSTRACT

Disclosed are various embodiments of an external hair strainer. The external hair strainer can have a number of components. For example, the external hair strainer can include a rim positioned on a first plane. The external hair strainer can also include a button positioned on a second plane parallel to the first plane. In some instances, the external hair strainer can include a suction cup protruding from the button in the direction of the rim. Moreover, the external hair strainer can have a plurality of spokes connecting an inner diameter of the rim to an outer diameter of the button, each of the plurality of spokes comprising a bend.

20 Claims, 4 Drawing Sheets

EXTERNAL HAIR STRAINER

CROSS-REFERENCE TO RELATED APPLICATIONS

This application claims priority to, and the benefit of, U.S. Provisional Patent Application No. 62/502,971, entitled "EXTERNAL HAIR STRAINER" and filed on May 8, 2017, which is incorporated by reference as if set forth herein in its entirety.

BACKGROUND

Hair can accumulate in drains, such as bathtub, shower, and sink drains. As hair accumulates, the flow of water through the drain decreases until the drain clogs and water can no longer flow through the drain. The accumulated hair must be physically removed by either disassembling the drain, running a rotary pipe-snake through the drain to clear the clog, or adding harsh chemicals into the drain in an attempt to dissolve the hair. Each of these processes risks damaging the drain itself or injuring the individual attempting to clear the drain.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

Figure 1A:
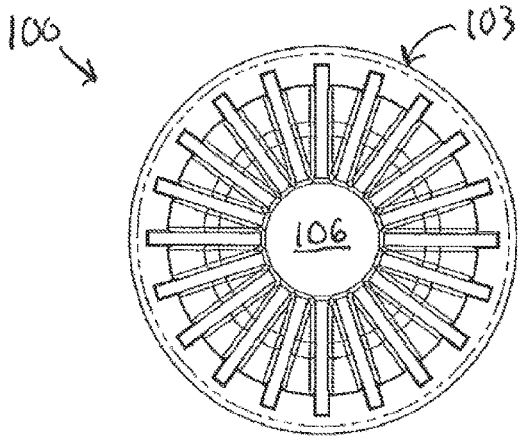
FIGS. 1A-1C are perspective views of an external hair strainer in accordance with various embodiments of the present disclosure.

FIG. 1A shows a top perspective view of an external hair strainer 100. The external hair strainer 100 can be affixed to a drain stopper (e.g., a bathtub or kitchen drain stopper) in order to prevent hair from entering and accumulating in a drain. The external hair strainer 100 may be manufactured from any number of flexible materials, including various silicone compounds, rubber or synthetic rubber compounds, or other appropriate materials. The external hair strainer 100 can include a rim 103 at the base of the external hair strainer 100 and a button 106 at the top of the external hair strainer 100.

Figure 1B:
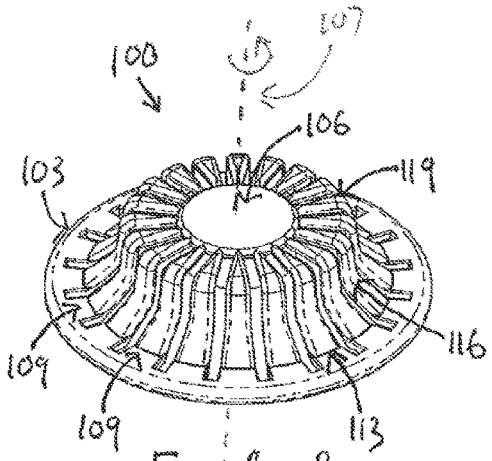

FIG. 1B shows another perspective view of the external hair strainer 100. As shown, the external hair strainer 100 can include a plurality of spokes 109 connecting the rim 103 to the button 106, a first bend 113, and a second bend 116. The rim 103 is positioned to form at least a partial seal with a surface, such as a bathtub surface or sink surface. The button 106 can be depressed to engage the external hair strainer 100 with a drain stopper, such as a stopper for a bath tub or sink.

FIG. 1B shows another perspective view of the external hair strainer 100. As shown, a rim 103 at the base of the external hair strainer 100 is connected to the button 106 at the top of the external hair strainer 100 by a plurality of spokes 109. Each of the spokes 109 can be positioned in a substantially parallel manner with respect to adjacent spokes 109. The rim 103 is located on a first plane, while the button 106 is located on a second plane parallel to the first plane. The rim 103 and the button 106 are both centered along the same axis of rotation 107 that runs perpendicular to the first plane and the second plane.

Each of the plurality of spokes 109 are tapered as they connect the inner diameter of the rim 103 of the external hair strainer 100 with the outer diameter of the button 106, thereby forming a collapsible skirt extending from the button 106 to the rim 103. The inner diameter of the rim 103 is greater than the outer diameter of the button 106 and each of the plurality of spokes 109 is narrower at a first connection with the button 106 and wider at a second connection with the rim 103. In some embodiments, the spokes 109 may be set at equidistant points along the rim 103 with respect to adjacent spokes 109. Each spoke 109 in the plurality of spokes 109 may be separated from other spokes 109 by gaps that allow water or other liquids to pass through the external hair strainer 100 while preventing hair or other objects from entering a drain.

A first bend 113, second bend 116, and third bend 119 on each spoke 109 prevent the external hair catcher 100 from returning to its original shape when the plurality of spokes 109 are flexed as a result of the button 106 being depressed. The first bend 113 and the second bend 116 may be placed one above the other at a point approximately half-way between the inner diameter of the rim 103 and the outer diameter of the button 106. For instance, the first bend 113 and the second bend 116 may be located on separate horizontal planes crossing through the spoke 109 and also located along the same line running perpendicularly through the separate horizontal planes. This arrangement increases the hoop strength of the external hair catcher 100 to prevent the external hair catcher 100 from inverting when the spokes 109 are flexed. In some alternative embodiments, the second bend 116 and the third bend 119 may instead be placed one above the other at a point approximately half-way between the inner diameter of the rim 103 and the outer diameter of the button 106. For instance, the second bend 116 and the third bend 119 may be located on separate horizontal planes crossing through the spoke 109 and also located along the same line running perpendicularly through the separate horizontal planes. This arrangement similarly increases the hoop strength of the external hair catcher 100 to prevent the external hair catcher 100 from inverting when the spokes are flexed. Moreover, the first bend 113 of each spoke 109 may be located at the same position on each spoke 109, forming a first concentric circle between the rim 103 and the button 106. Likewise, the second bend 116 of each spoke 109 may be located at the same position on each spoke 109, forming a second concentric circle between the rim 103 and the button 106. Similarly, the third bend 119 of each spoke 109 may be located at the same position on each spoke 109, forming a third concentric circle between the rim 103 and the button 106.

Figure 1C:
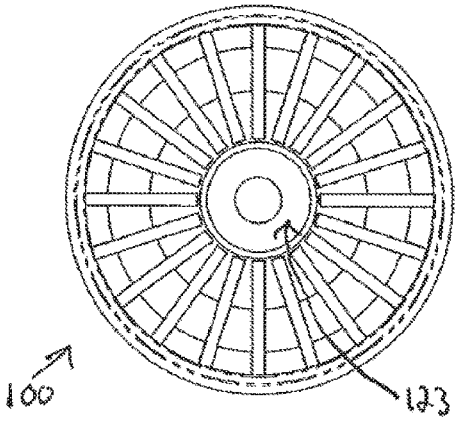

FIG. 1C shows a bottom perspective view of an external hair strainer 100. In the bottom perspective view, a suction cup 123 within the collapsible skirt of the external hair strainer 100 can be seen. The suction cup 123 can extend from the button 106 towards the rim 103 and may also be centered on the axis of rotation 107. In some embodiments, multiple smaller suction cups 123 may be positioned along the bottom of the button 106 instead of a larger, single suction cup 123.

Figure 1D:
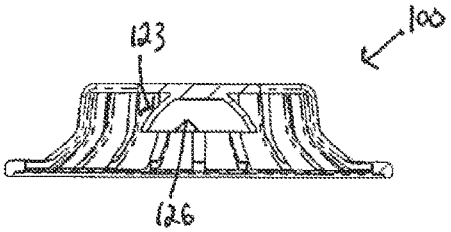
FIG. 1D is a cross sectional view of the perspective view of the external hair strainer, illustrating a suction cup of the external hair strainer in accordance with various embodiments of the present disclosure.

FIG. 1D depicts a cross sectional view of the external hair strainer 100, illustrating the suction cup 123 of the external hair strainer 100. As shown, the suction cup 123 extends from a bottom surface of the button 106, placing the suction cup 123 within the collapsible skirt formed by the plurality of spokes 109. The suction cup 123 also includes an internal cavity 126. The internal cavity 126 allows for the suction cup 123 to generate suction when pressed against a surface. Moreover, the bottom of the suction cup 123, as illustrated, lies within a third plane positioned between, and parallel to, the first plane containing the rim 103 and the second plane containing the button 106.

Figure 2:
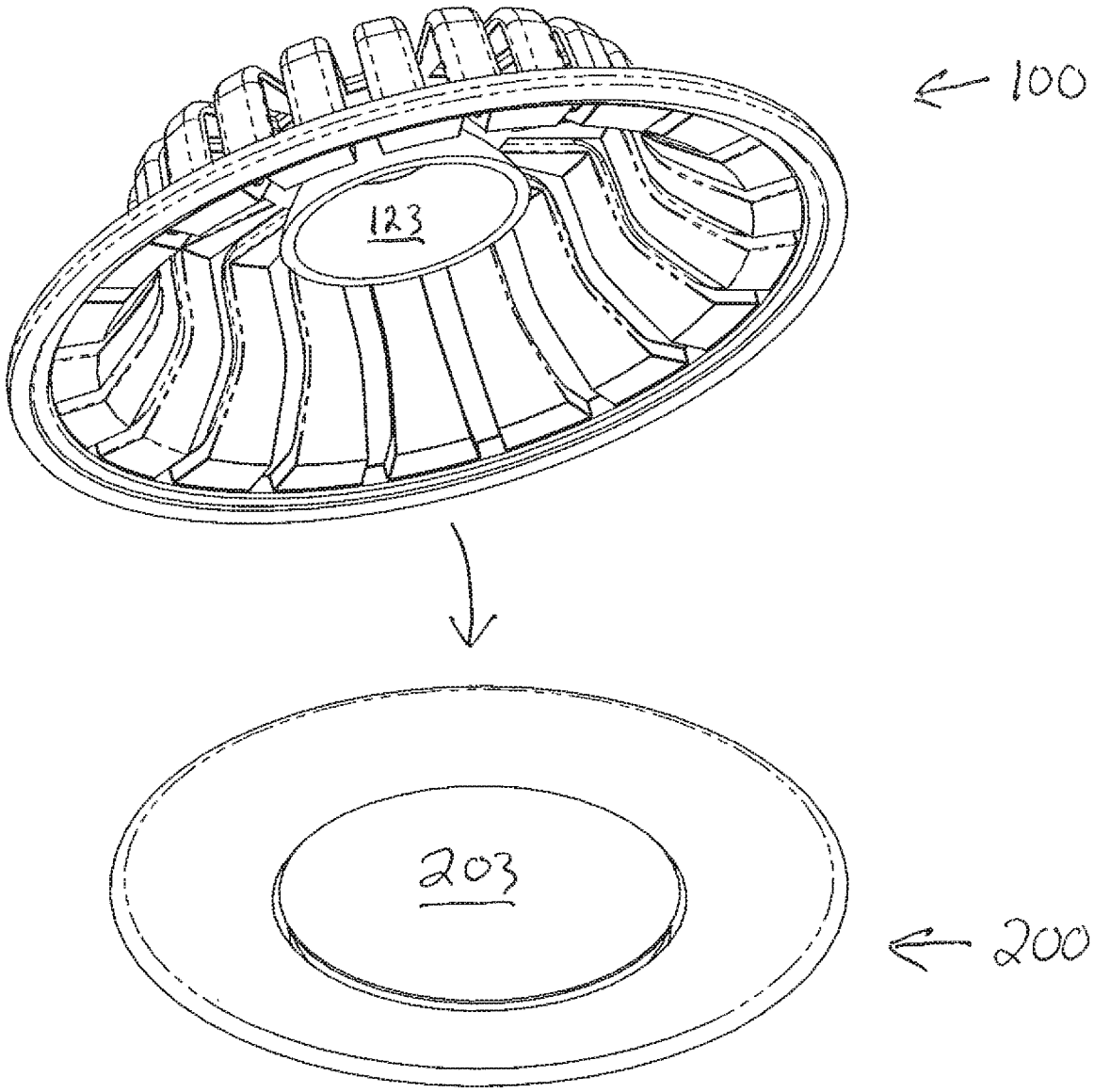
FIG. 2 illustrates the application of the external hair strainer of FIGS. 1A-D to a drain stopper according to various embodiments of the present disclosure.

FIG. 2 illustrates an example of how the external hair strainer 100 could be attached to a drain stopper 200. As illustrated, the suction cup 123 is placed on the top surface 203 of the drain stopper. When the button 106 (FIGS. 1A-D) is depressed, the suction cup 123 generates suction, thereby attaching the external hair strainer 100 to the drain stopper 200. The spokes 109 can flex at the first bend 113, second bend 116, or the third bend 119 to allow the collapsible skirt formed by the plurality of spokes 109 to partially collapse, such that the rim 103 can remain substantially within the first plane and maintain contact with a surface surrounding the drain stopper 200 (e.g., a sink surface) as the button 106 is depressed.

Figure 3:
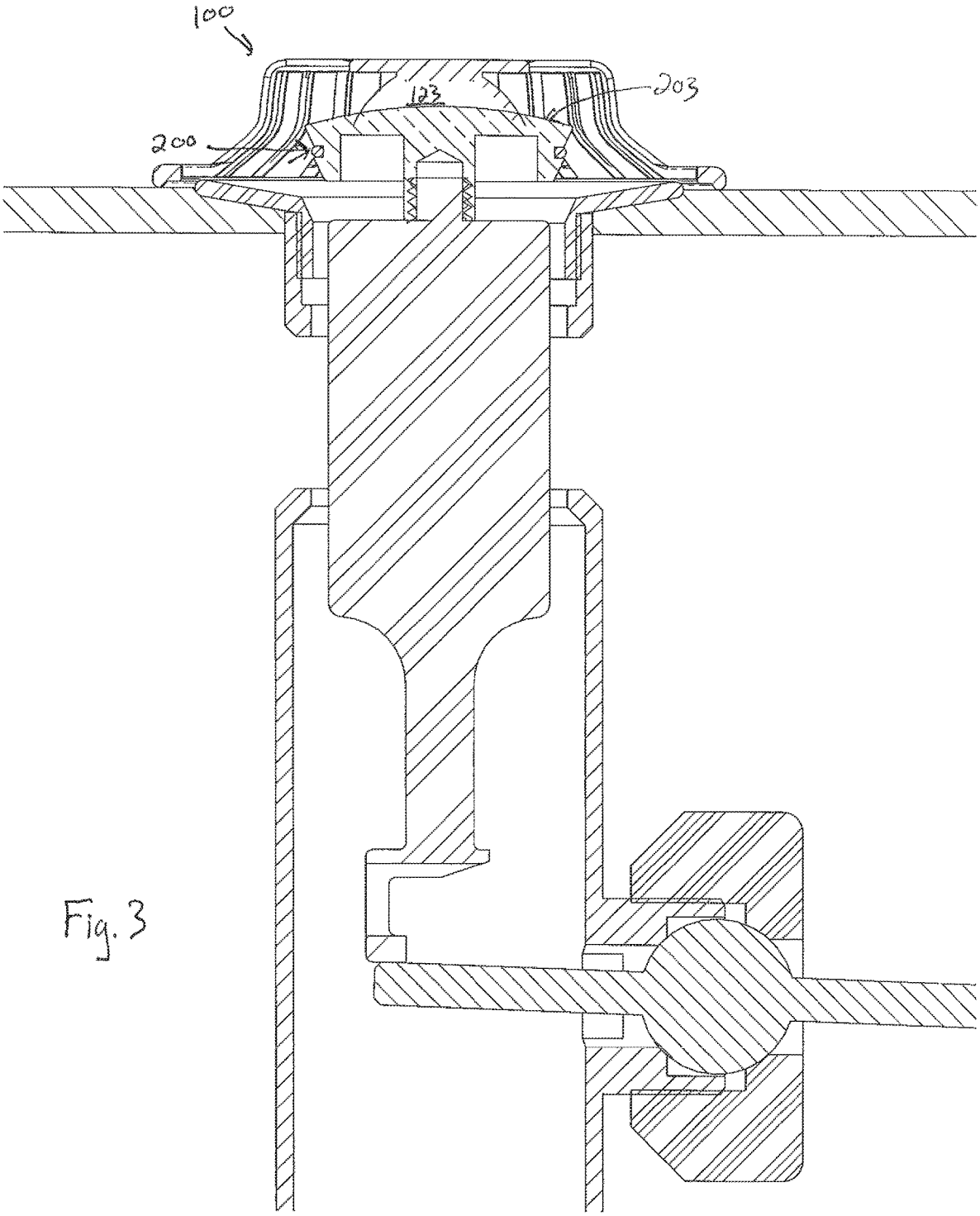
FIG. 3 is a cross sectional view illustrating the external hair strainer positioned on top of a drain stopper of a bathtub in accordance with various embodiments of the present disclosure.

FIG. 3 represents a cross-sectional view illustrating the external hair strainer 100 positioned on top of a drain stopper 200 of a sink in accordance with various embodiments of the present disclosure. As illustrated, the suction cup 123 is placed on the top surface 203 of the drain stopper 200. The suction cup 123 forms at least a partial seal with the top surface 203 of the drain stopper 200, thereby attaching the external hair strainer 100 to the drain stopper 200.

Figure 4:
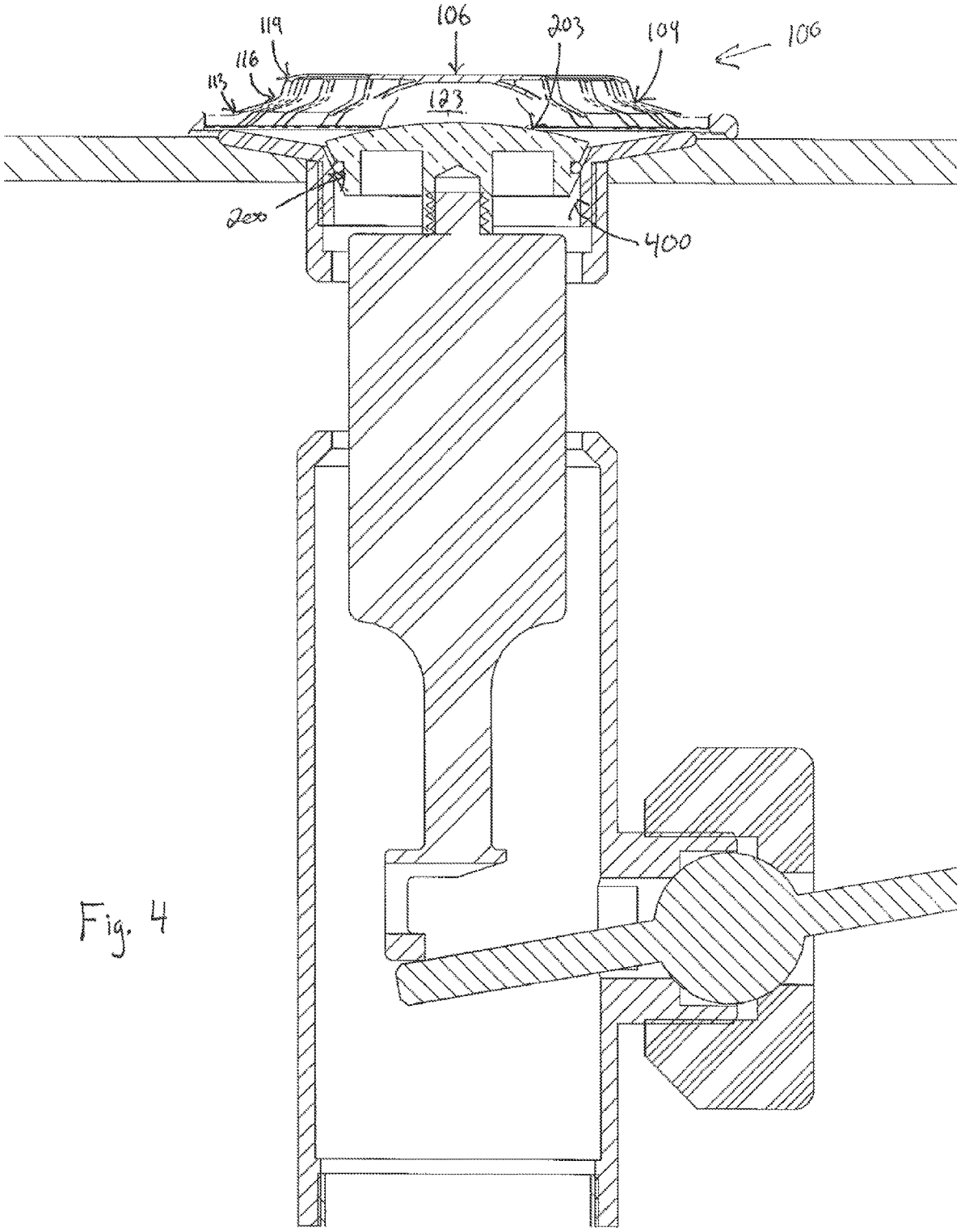
FIG. 4 is a cross sectional view illustrating the external hair strainer positioned on top of a drain stopper of a bathtub in accordance with various embodiments of the present disclosure.

FIG. 4 represents a cross-sectional view illustrating the external hair strainer 100 positioned on top of a drain stopper 200 of a sink in accordance with various embodiments of the present disclosure. As illustrated, the suction cup 123 is placed on the top surface 203 of the drain stopper 200, and the button 106 is depressed, causing the drain stopper 200 to engage the drain 400 to prevent liquids from draining through the drain 400. Due to the depression of the button 106, each of the plurality of spokes 109 bend at the first bend 113, second bend 116, and third bend 119. The bending of the first bend 113, second bend 116, and third bend 119 allow for a complete or substantially complete collapse of the collapsible skirt formed by the plurality of spokes 109 in order to prevent the external hair strainer 100 from returning to its original upright position by minimizing the amount of force applied to the suction cup 123 that could potentially break the seal of the suction cup 123 with the top surface 203 of the drain stopper 200.

While sink drains were described it should be noted that this hair catcher is not limited to sink drains as the same design can also be used in bathroom tub drains as well as kitchen sink drains or any other drain as is appropriate.

The following is claimed:

1. An apparatus, comprising:

a rim positioned on a first plane;

a button positioned on a second plane parallel to the first plane;

a suction cup protruding from the button in a direction of the rim; and a collapsible skirt formed by a plurality of spokes connecting an inner diameter of the rim to an outer diameter of the button, each of the plurality of spokes comprising a first bend and a second bend, wherein the first bend and the second bend are curved inward toward an interior of the collapsible skirt, wherein the plurality of spokes have an inclined surface between the first bend and the second bend, wherein the first bend and the second bend of the plurality of spokes enable the collapsible skirt to maintain a collapsed state toward a drain when the suction cup is attached to a drain stopper from the drain and the drain stopper is in a closed position in a sink.

2. The apparatus of claim 1, wherein the plurality of spokes connect to the inner diameter of the rim at equidistant points.

3. The apparatus of claim 1, wherein the plurality of spokes connect to the outer diameter of the button at equidistant points.

4. The apparatus of claim 1, wherein the first bend and the second bend of the plurality of spokes are located at the same position on each of the respective ones of the plurality of spokes to form a concentric circle between the rim and the button.

5. The apparatus of claim 1, wherein the rim, the button, and the plurality of spokes are manufactured from a flexible material.

6. The apparatus of claim 1, wherein the rim and the button are centered on an axis of rotation perpendicular to the first plane and the second plane.

7. The apparatus of claim 1, wherein each of the plurality of spokes are tapered, wherein each of the plurality of spokes are narrower at a first connection with the button and wider at a second connection with the rim.

8. A device, comprising:

a rim positioned on a first plane;

a button positioned on a second plane parallel to the first plane;

a suction cup protruding from the button in a direction of the rim; and a collapsible skirt formed by a plurality of spokes connecting an inner diameter of the rim to an outer diameter of the button, each of the plurality of spokes comprising:

a first bend located at the same first position on each of the respective ones of the plurality of spokes to form a first concentric circle between the rim and the button;

a second bend located at the same second position on each of the respective ones of the plurality of spokes to form a second concentric circle between the rim and the button;

a third bend located at the same third position on each of the respective ones of the plurality of spokes to form a third concentric circle between the rim and the button; and wherein the first bend and the second bend are curved inward toward an interior of the collapsible skirt, wherein the plurality of spokes have an inclined surface between the first bend and the second bend, wherein the collapsible skirt is configured to collapse toward a drain when the suction cup is attached to a drain stopper from the drain and the drain stopper is moved from an open position to a closed position in a sink.

9. The device of claim 8, wherein the first bend and the second bend of each one of the plurality of spokes are located on separate parallel horizontal planes crossing through the spoke and along a line running perpendicularly through the separate parallel horizontal planes, the line being located at a point approximately half-way between the inner diameter of the rim and the outer diameter of the button.

10. The device of claim 8, wherein the second bend and the third bend of each one of the plurality of spokes are located on separate parallel horizontal planes crossing through the spoke and along a line running perpendicularly through the separate parallel horizontal planes, the line being located at a point approximately half-way between the inner diameter of the rim and the outer diameter of the button.

11. The device of claim 8, wherein the plurality of spokes connect to the inner diameter of the button at equidistant points.

12. The device of claim 8, wherein the plurality of spokes connect to the outer diameter of the rim at equidistant points.

13. The device of claim 8, wherein the rim and the button are centered on an axis of rotation perpendicular to the first plane and the second plane.

14. The device of claim 13, wherein the suction cup is centered on the axis of rotation perpendicular to the first plane and the second plane.

15. The device of claim 8, wherein each of the plurality of spokes are tapered and each of the plurality of spokes are narrower at a first connection with the button and wider at a second connection with the rim.

16. An apparatus, comprising:

a rim positioned on a first plane;

a button positioned on a second plane parallel to the first plane;

a suction cup protruding from the button in the direction of the rim; and a collapsible skirt formed by a plurality of spokes connecting an inner diameter of the rim to an outer diameter of the button, each of the plurality of spokes comprising:

a first bend located at the same first position on each of the respective ones of the plurality of spokes to form a first concentric circle between the rim and the button;

a second bend located at the same second position on each of the respective ones of the plurality of spokes to form a second concentric circle between the rim and the button; and a third bend located at the same third position on each of the respective ones of the plurality of spokes to form a third concentric circle between the rim and the button; and wherein the second bend and the third bend of each one of the plurality of spokes are located on separate parallel horizontal planes crossing through the spoke and along a line running perpendicularly through the separate parallel horizontal planes, the line being located at a point approximately half-way between the inner diameter of the rim and the outer diameter of the button.

17. The apparatus of claim 16, wherein the rim, the button, and the suction cup are centered on an axis of rotation perpendicular to the first plane and the second plane.

18. The apparatus of claim 16, wherein the plurality of spokes connect to the inner diameter of the button at equidistant points and connect to the outer diameter of the rim at equidistant points.

19. The apparatus of claim 16, wherein each of the plurality of spokes are tapered and each of the plurality of spokes are narrower at a first connection with the button and wider at a second connection with the rim.

20. The device of claim 8, wherein the third bend is curved away from the interior of the collapsible skirt.

* * * * *